US006499875B1

(12) United States Patent
Telly

(10) Patent No.: US 6,499,875 B1
(45) Date of Patent: Dec. 31, 2002

(54) METHOD AND ARTICLE FOR ADJUSTING THE FIT OF A WRISTWATCH

(76) Inventor: Reginald O. Telly, 40002 N. Tothill Cir., Sterling Heights, MI (US) 48310

( * ) Notice: Subject to any disclaimer, the term of this patent is extended or adjusted under 35 U.S.C. 154(b) by 0 days.

(21) Appl. No.: 09/363,435

(22) Filed: Jul. 29, 1999

Related U.S. Application Data

(63) Continuation-in-part of application No. 08/946,903, filed on Oct. 8, 1997, now abandoned.

(51) Int. Cl.[7] ..... A44C 5/00; G04B 37/00

(52) U.S. Cl. ..... 368/281; 368/282; 368/309; 224/171

(58) Field of Search ..... 368/276, 281, 368/282, 283, 286, 287, 309; 224/164, 171

(56) References Cited

U.S. PATENT DOCUMENTS 2,546,859 A * 3/1951 Innes
2,562,607 A * 7/1951 Ford
2,711,068 A * 6/1955 Kelly
3,149,452 A * 9/1964 Smith ..... 368/686

* cited by examiner

*Primary Examiner*—Vit Miska
(74) *Attorney, Agent, or Firm*—Vanophem & Vanophem, P.C.

(57) ABSTRACT

Looseness in the fit of a wristwatch to the wrist of a user is taken up by affixing a thin spacer to the back of the watch. The spacer is formed from a sheet of thermoplastic material with a pressure sensitive adhesive on a surface thereof, and is affixed to the watch, after cleaning of the watch if necessary, by pressing the pressure sensitive adhesive surface of the spacer against the watch. Spacers are packaged in spaced apart multiples on a display card, with a removable transparent film covering the spacers on the display card.

12 Claims, 1 Drawing Sheet

METHOD AND ARTICLE FOR ADJUSTING THE FIT OF A WRISTWATCH

This application is a continuation-in-part of application Ser. No. 08/946,903, filed Oct. 8, 1997, now abandoned.

BACKGROUND OF THE INVENTION

1. Field of the Invention

This invention relates to a method and article for adjusting the fit of a wristwatch between predetermined positions of a watchband to which the wristwatch is secured.

2. Description of the Related Art

Many wristwatches are retained on the wrist of a user by a watchband that has a plurality of spaced apart notches or positions for adjusting the size of the opening circumscribed by the watch and the band to the size of a user's wrist. Unfortunately, the spacing between the adjustment positions of the notches or other adjustment positions, which typically can be of the order of ⅛ inch–¼ inch, often results in a fit that is either a little too loose or a little too tight. In either case, such an ill-fit will cause annoyance or even discomfort to the user.

Various approaches to providing an adjustable fit watchband are taught by the prior art. Some of these approaches include those taught by U.S. Pat. No. 5,425,007 (Walter et al.); U.S. Pat. No. 5,215,235 (Maekawa et al.); U.S. Pat. No. 4,905,879 (Piccone); U.S. Pat. No. 2,425,894 (Moyer); and U.S. Pat. No. 2,538,265 (Paston). Each of these references requires replacement of an existing ill-fitting watchband to correct an ill-fitting condition, and many rely on a plurality of spaced apart notches or other positions of adjustments to provide proper adjustment, which does not solve an ill-fitting condition resulting from finite line spacing between positions of adjustment.

SUMMARY OF THE INVENTION

According to the present invention there is provided a method of and article for adjusting the fit of an existing and otherwise ill-fitting watchband of a wristwatch between fixed positions of adjustments. According to the method of this invention, a thin spacer, for example a spacer of a thickness of approximately 1/16 inch, made of a stiff rigid plastic is adhesively secured to the reverse side of the watch case, for example by a pressure sensitive adhesive on one of the opposed surfaces of the spacer. The use of the 1/16 inch thick spacer will result in an adjustment of the link of the watchband of ⅛ inch, which is often less than the spacing between the spaced apart positions of adjustments of the watchband. Thus, to practice the method of the present invention, the watchband is adjusted to a position in which the fit is a little too loose, then the fit is tightened by affixing the spacer to the reverse side of the watch case, after suitably cleaning the reverse side of the watch case to remove body oils or other surface contaminates thereon.

The article of the present invention is the spacer, which is preferably formed of a relatively inexpensive, durable stiff rigid plastic that can be placed in contact with the wrist of the user without causing an allergic reaction or other injury thereto. Further the spacer is sufficiently thin to resiliently conform with various irregularities that may be on the back of the watch. Nylon, polypropylene and polyethylene are examples of suitable materials for use in the manufacture of such spacers, and each can readily be provided with a suitable pressure sensitive adhesive on one of its surfaces to permit it to be applied to the reverse side of a watch case in a secure, but removable, manner. Such spacers can be readily packaged in multiples on a card with a peel-off tape covering the pressure sensitive adhesive, which is disposed next to the visible surface of the card as displayed in a retail store, with a suitable removable transparent film covering the spacers on the card.

Accordingly, it is an object of the present invention to provide a method of and article for adjusting the fit of a wristwatch. More particularly, it is an object of the present invention to provide a method of and article for adjusting the fit of an existing, ill-fitting wristwatch.

For a further understanding of the present invention and the objects thereof, attention is directed to the drawing and the following brief description thereof, to the detail description of the preferred embodiment and to the appended claims.

DETAILED DESCRIPTION OF THE PREFERRED EMBODIMENT

Figure 1:
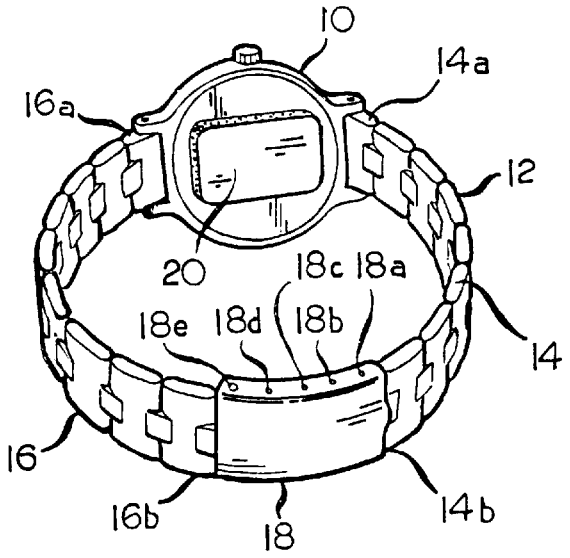
FIG. 1 is a perspective view of a wristwatch having an article according to the present invention affixed thereto.

A wristwatch 10 with a double-ended watchband 12 secured to opposite ends of the wristwatch 10 is illustrated in FIG. 1. The watchband 12 is made up of first and second flexible elements 14 and 16, respectively, each of which has a first end, 14*a* and 16*a*, respectively, secured to the wristwatch 10 and a second end, 14*b* and 16*b*, respectively. The second ends 14*b* and 16*b* of the flexible elements 14 and 16, respectively, are connected by a linkage mechanism 18, of conventional construction. The linkage mechanism 18 has a fixed setting 18*a*, by which the second end 14*b* of the flexible element 14 may be secured to the mechanism 18, and the linkage mechanism 18 has additional fixed settings, shown as the fixed settings 18*b*, 18*c*, 18*d*, 18*e*, by which the second end 16*b* of the flexible element 16 may be secured to the linkage mechanism 18.

The size of the opening circumscribed by the wristwatch 10 and the watchband 12, including the linkage mechanism 18, thus, may be appropriately sized to the size of the wrist of the user, depending on whether the second end 16*b*, of the flexible element 16 is connected to the linkage mechanism 18 at the fixed setting 18*b*, the fixed setting 18*c*, the fixed setting 18*d* or the fixed setting 18*e*.

The problem with accurately sizing the size of the opening circumscribed by the wristwatch 10 and the watchband 12, including the linkage mechanism 18, to the wrist of a user is that a spacing, typically to the order of ⅛ inch–¼ inch, is required between adjacent fixed settings 18*b*, 18*c*, 18*d*, 18*e* of the linkage mechanism 18. Thus, the wristwatch 10 will be held somewhat too tightly or somewhat too loosely on the wrist of a user. To overcome this problem, a thin stiff rigid spacer 20 is secured to the back of watch 10, for example, by a pressure sensitive adhesive on the surface of the spacer 20 that is to be positioned adjacent to the wristwatch 10. The spacer 20 is preferably formed from a sheet of a suitable thermoplastic material, such as Nylon (polyamide), polyethylene or polypropylene, for example, by die-cutting, and is selected on the basis of durability (i.e. durometer range 45 to 85) and hypoallergenic properties.

Preferably, a peel-off tape is applied over the pressure sensitive surface of the spacer 20 to preserve the integrity of the pressure sensitive surface until the time of use. In any case, the back of the wristwatch 10 should be properly cleaned to remove body oils and other contaminants before applying the spacer 20 thereto.

To properly size the wristwatch 10 and the watchband 12, including the linking mechanism 18, to the wrist of the user, the second end 16*b* of the band element 16 should be secured to the linkage mechanism 18 at one of the fixed settings 18*b*, 18*c*, 18*d* or 18*e* that will make the fit a little too loose. Then, the spacer 20 is secured to the back of the wristwatch 10, as described, to take up the slack that otherwise would remain in the fit. In that regard, the use of a spacer 20 with a thickness of 1/16 inch will have the same effect of changing the connection of the band element 16 to the linkage mechanism 18 by 1/8 inch, or double the thickness of the spacer 20.

Figure 2:
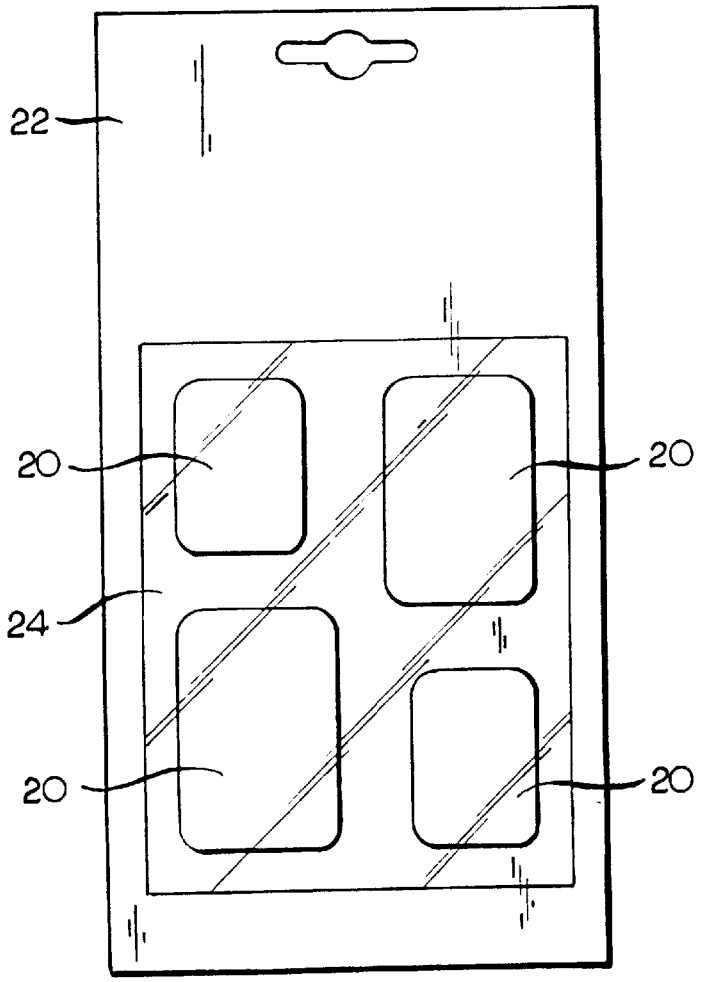
FIG. 2 is a plan view of a display card for packaging, distributing, displaying and marketing a multiplicity of articles according to the present invention.

The spacers are impervious to perspiration so as to avoid any changes in thickness due to sweat. Further, the spacers are sufficiently thin to enable the spacers to accommodate any irregularity in the surface of the back of the watch. In other words the spacer is sufficiently resilient to conform to irregularities in the surface of the back of the watch. Spacers corresponding to the spacer 20 maybe conveniently packaged, distributed, displayed and marketed in multiples of such spacers, preferably in various sizes, by affixing such spacers to a display card 22, as shown in FIG. 2, four such spacers being affixed to the display card 22. The spacers 20 are preferably secured to the display card 22 by covering them with a readily removable transparent film 24.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. The method of adjusting the fit of a wristwatch having a watchband with a plurality of spaced apart adjustment settings, said wristwatch and said watchband defining an opening within which a user's wrist is fit, said method comprising the steps of:

selecting one of said plurality of spaced apart adjustment settings to establish the size of said opening and thereby create a fit that is too loose; and affixing a rigid spacer to a back of said wristwatch to effectively reduce the size of said opening to the size of said user's wrist and thereby take up the looseness in the fit.

2. The method according to claim 1, wherein the thin spacer has a pressure sensitive adhesive on a surface thereof, and wherein the thin spacer is affixed to the wristwatch by pressing the surface with the pressure sensitive adhesive against the wristwatch.

3. The method according to claim 2 further comprising, before affixing the thin spacer to the wristwatch, the step of:

cleaning a surface of a wristwatch to which the thin spacer is to be applied.

4. The method according to claim 2, wherein the spacer has a peel-off tape applied to the pressure sensitive adhesive surface of the spacer, further comprising before affixing the thin spacer to the watch, the step of:

removing the peel-off tape from the pressure sensitive adhesive surface of the spacer.

5. The method according to claim 1, wherein the spacer is formed from a sheet of a thermoplastic material by die cutting.

6. The method according to claim 5, wherein the thermoplastic material is selected from the group consisting of nylon, polypropylene and polyethylene.

7. A method of adjusting the fit of a wristwatch having a watchband with a plurality of spaced apart adjustment settings, said wristwatch and said watchband defining an opening within which a user's wrist is fit, said method comprising the steps of:

selecting one of said plurality of spaced apart adjustment settings to establish the size of said opening and thereby create a loose fit around said user's wrist;

selecting a rigid spacer of predetermined thickness; and affixing said rigid spacer to a back of said wristwatch to effectively reduce the size of said opening by an amount less than the spacing between said plurality of spaced apart adjustment settings of said watchband;

whereby said opening of said watchband is more finely adjusted between said plurality of spaced apart adjustment settings to take up the looseness in the fit between said wristwatch and said user's wrist such that said wristwatch more closely fits said user's wrist.

8. The method according to claim 7 wherein said rigid spacer has a pressure sensitive adhesive on a surface thereof, and wherein said rigid spacer is affixed to said wristwatch by pressing said surface with said pressure sensitive adhesive against said wristwatch.

9. The method according to claim 8 and further comprising, before affixing said rigid spacer to said wristwatch, the step of:

cleaning a surface of said wristwatch to which said rigid spacer is to be applied.

10. The method according to claim 8 wherein said rigid spacer has a peel-off tape applied to said pressure sensitive adhesive surface of said rigid spacer, and further comprising, before affixing said rigid spacer to said wristwatch, the step of:

removing said peel-off tape from said pressure sensitive adhesive surface of said rigid spacer.

11. The method according to claim 7 wherein said rigid spacer is formed from a sheet of a thermoplastic material by die cutting.

12. The method according to claim 11 wherein said thermoplastic material is selected from the group consisting of nylon, polypropylene and polyethylene.

* * * * *